US008316541B2

(12) United States Patent
Patel et al.

(10) Patent No.: US 8,316,541 B2
(45) Date of Patent: Nov. 27, 2012

(54) COMBUSTOR HEAT SHIELD WITH INTEGRATED LOUVER AND METHOD OF MANUFACTURING THE SAME

(75) Inventors: Bhawan B. Patel, Mississauga (CA); Lorin Markarian, Etobicoke (CA); Melissa Despres, Verdun (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1177 days.

(21) Appl. No.: 11/771,141

(22) Filed: Jun. 29, 2007

(65) Prior Publication Data

US 2009/0000303 A1 Jan. 1, 2009

(51) Int. Cl.

| | |
|---|---|
| ***B21K 25/00*** | (2006.01) |
| ***B22F 7/00*** | (2006.01) |
| ***F02C 1/00*** | (2006.01) |
| ***F16P 3/02*** | (2006.01) |

(52) U.S. Cl. ..... 29/889.22; 29/890.03; 60/39.11; 60/752; 60/755; 419/5

(58) Field of Classification Search ..... 29/890.03, 29/890.039, 889.22; 60/752, 755, 804, 39.11; 419/5

See application file for complete search history.

(56) References Cited

U.S. PATENT DOCUMENTS

| | | | |
|---|---|---|---|
| 1,751,448 | A | 3/1930 | Campbell, Jr. |
| 2,468,824 | A | 5/1949 | Hughey |
| 2,669,090 | A | 2/1954 | Jackson |
| 2,694,245 | A | 11/1954 | Rogers et al. |
| 2,775,566 | A | 12/1956 | Crowley |
| 2,939,199 | A | 6/1960 | Strivens |
| 3,169,367 | A | 2/1965 | Hussey |
| 3,266,893 | A | 8/1966 | Duddy |
| 3,351,688 | A | 11/1967 | Kingery et al. |
| 3,410,684 | A | 11/1968 | Printz |
| 3,413,704 | A | 12/1968 | Addoms, Jr. et al. |
| 3,416,905 | A | 12/1968 | Waugh |
| 3,523,148 | A | 8/1970 | Boyer et al. |
| 3,595,025 | A | 7/1971 | Stöckel et al. |
| 3,608,309 | A | 9/1971 | Hill et al. |
| 3,615,054 | A | 10/1971 | La Botz |
| 3,698,849 | A | 10/1972 | Czerski |
| 3,704,499 | A | 12/1972 | Majkrzak et al. |
| 3,775,352 | A | 11/1973 | Leonard, Jr. |
| 3,782,989 | A | 1/1974 | Mansur |
| 3,888,663 | A | 6/1975 | Reichman |
| 3,889,349 | A | 6/1975 | Kaufman |
| 3,925,983 | A | 12/1975 | La Botz |
| 3,982,778 | A | 9/1976 | Spencer et al. |
| 4,011,291 | A | 3/1977 | Curry |
| 4,029,476 | A | 6/1977 | Knopp |

(Continued)

FOREIGN PATENT DOCUMENTS

| | | |
|---|---|---|
| CA | 983215 | 2/1976 |

(Continued)

OTHER PUBLICATIONS

U.S. Appl. No. 60/139,354, filed Jun. 15, 1999, Lasalle, et al.

(Continued)

*Primary Examiner* — Alexander P Taousakis
(74) *Attorney, Agent, or Firm* — Norton Rose Canada LLP

(57) ABSTRACT

A combustor dome heat shield and a louver are separately metal injection molded and then fused together to form a one-piece combustor heat shield.

6 Claims, 4 Drawing Sheets

U.S. PATENT DOCUMENTS 4,076,561 A 2/1978 Lee et al.
4,094,061 A 6/1978 Gupta et al.
4,176,433 A * 12/1979 Lee et al. ..... 29/889.1
4,197,118 A 4/1980 Wiech, Jr.
4,225,345 A 9/1980 Adee et al.
4,226,088 A 10/1980 Tsukahara et al.
4,236,923 A 12/1980 Takahashi et al.
4,246,757 A 1/1981 Heberling
4,274,875 A 6/1981 Cadle et al.
4,280,973 A 7/1981 Moskowitz et al.
4,283,360 A 8/1981 Henmi et al.
4,386,960 A 6/1983 Iacovangelo et al.
4,415,528 A 11/1983 Wiech, Jr.
4,419,413 A 12/1983 Ebihara
4,472,350 A 9/1984 Urano
4,475,344 A 10/1984 Mumford et al.
4,535,518 A 8/1985 Jaqua
4,590,769 A 5/1986 Lohmann et al.
4,615,735 A 10/1986 Ping
4,661,315 A 4/1987 Wiech, Jr.
4,702,073 A 10/1987 Melconian
4,708,838 A 11/1987 Bandyopadhyay et al.
4,734,237 A 3/1988 Fanelli et al.
4,765,950 A 8/1988 Johnson
4,780,437 A 10/1988 Smith
4,783,297 A 11/1988 Ito et al.
4,792,297 A 12/1988 Wilson
4,816,072 A 3/1989 Harley et al.
4,839,138 A 6/1989 Filz
4,874,030 A 10/1989 Kuphal et al.
4,881,431 A 11/1989 Bieneck
4,898,902 A 2/1990 Nagai et al.
4,913,739 A 4/1990 Thümmler et al.
5,021,208 A 6/1991 Ludwig et al.
5,059,387 A 10/1991 Brasel
5,059,388 A 10/1991 Kihara et al.
5,064,463 A 11/1991 Clomek
5,094,810 A 3/1992 Shira
5,098,469 A 3/1992 Rezhets
5,129,231 A 7/1992 Becker et al.
5,135,712 A 8/1992 Kijima et al.
5,155,158 A 10/1992 Kim
5,165,226 A 11/1992 Newton et al.
5,215,946 A 6/1993 Minh
5,244,623 A 9/1993 King
5,250,244 A 10/1993 Kimura et al.
5,279,787 A 1/1994 Oltrogge
5,284,615 A 2/1994 Ueda et al.
5,286,767 A 2/1994 Rohrbach et al.
5,286,802 A 2/1994 Uesugi et al.
5,307,637 A 5/1994 Stickles et al.
5,310,520 A 5/1994 Jha et al.
5,312,582 A 5/1994 Donado
5,328,657 A 7/1994 Kamel et al.
5,332,537 A 7/1994 Hens et al.
5,338,617 A 8/1994 Workinger et al.
5,350,558 A 9/1994 Kawato et al.
5,366,679 A 11/1994 Streicher
5,368,795 A 11/1994 Quadir
5,380,179 A 1/1995 Nishimura et al.
5,397,531 A 3/1995 Peiris et al.
5,398,509 A 3/1995 North et al.
5,403,542 A 4/1995 Weinl et al.
5,409,650 A 4/1995 Holme
5,415,830 A 5/1995 Zhang et al.
5,421,853 A 6/1995 Chen et al.
5,423,899 A 6/1995 Krall et al.
5,429,792 A 7/1995 Luk
5,437,825 A 8/1995 Jensen
5,450,724 A 9/1995 Kesseli et al.
5,472,143 A 12/1995 Bartels et al.
5,476,632 A 12/1995 Shivanath et al.
5,482,671 A 1/1996 Weber
5,525,293 A 6/1996 Kagawa et al.
5,547,094 A 8/1996 Bartels et al.
5,554,338 A 9/1996 Sugihara et al.
5,574,957 A 11/1996 Barnard et al.
5,590,531 A 1/1997 Desaulty et al.
5,609,655 A 3/1997 Kesseli et al.
5,641,920 A 6/1997 Hens et al.
5,665,014 A 9/1997 Sanford et al.
5,669,825 A 9/1997 Shira
5,722,032 A 2/1998 Gay
5,730,929 A 3/1998 Majumdar et al.
5,848,350 A 12/1998 Bulger
5,864,955 A 2/1999 Hirai
5,950,063 A 9/1999 Hens et al.
5,956,955 A 9/1999 Schmid
5,977,230 A 11/1999 Yang et al.
5,989,493 A 11/1999 La Salle et al.
5,993,726 A 11/1999 Huang et al.
5,993,733 A 11/1999 Kawai
6,008,281 A 12/1999 Yang et al.
6,051,184 A 4/2000 Kankawa
6,060,017 A 5/2000 Yang et al.
6,071,325 A 6/2000 Schmitt
6,075,083 A 6/2000 Peiris
6,119,459 A 9/2000 Gomez et al.
6,159,265 A 12/2000 Kinoshita et al.
6,171,360 B1 1/2001 Suzuki et al.
6,224,816 B1 5/2001 Hull et al.
6,224,823 B1 5/2001 Lindenau et al.
6,289,677 B1 9/2001 Prociw et al.
6,319,437 B1 11/2001 Elsner et al.
6,321,449 B2 11/2001 Zhao et al.
6,322,746 B1 11/2001 LaSalle et al.
6,350,407 B1 2/2002 Sakata et al.
6,399,018 B1 6/2002 German et al.
6,406,663 B1 6/2002 Göransson
6,427,446 B1 8/2002 Kraft et al.
6,428,595 B1 8/2002 Hayashi et al.
6,468,468 B1 10/2002 Neubing et al.
6,560,964 B2 5/2003 Steinhorsson et al.
6,592,787 B2 7/2003 Pickrell et al.
6,669,898 B2 12/2003 Gressel et al.
6,730,263 B2 5/2004 Ernst et al.
6,759,004 B1 7/2004 Dwivedi
6,764,643 B2 7/2004 Sagawa et al.
6,838,046 B2 1/2005 Luc et al.
6,843,955 B2 1/2005 Ghosh et al.
6,849,230 B1 2/2005 Feichtinger
6,871,773 B2 3/2005 Fukunaga et al.
6,939,509 B2 9/2005 Kochanek
7,018,583 B2 3/2006 Berger et al.
7,052,241 B2 5/2006 Decker
7,827,800 B2 * 11/2010 Stastny et al. ..... 60/752
2002/0058136 A1 5/2002 Belhadjhamida
2002/0109260 A1 8/2002 Boechat
2003/0062660 A1 4/2003 Beard et al.
2003/0213249 A1 11/2003 Pacheco-Tougas et al.
2005/0036898 A1 * 2/2005 Sweetland ..... 419/6
2005/0254987 A1 11/2005 Azzi et al.
2006/0127268 A1 6/2006 Yano et al.
2007/0017817 A1 1/2007 Mueller et al.
2007/0020135 A1 1/2007 Jackson et al.
2007/0102572 A1 * 5/2007 Bohdal ..... 244/62
2007/0104585 A1 5/2007 Ochiai et al.

FOREIGN PATENT DOCUMENTS

CA 990978 6/1976
CA 996784 9/1976
CA 2230994 3/1997
CA 2204841 11/1997
CA 2342328 3/2000
CA 2347639 4/2000
CA 2327759 5/2001
CA 2388359 5/2001
CA 2418265 2/2002
CA 2381828 10/2002
EP 0 511 428 B1 9/1996
EP 1 046 449 B8 10/2000
JP 03 039405 A 2/1991
JP 08 025151 A 1/1996
JP 08260005 A 10/1996
WO WO 97 38811 A 10/1997
WO WO 00/12248 3/2000

OTHER PUBLICATIONS

U.S. Appl. No. 11/551,021, filed Oct. 19, 2006, Stastny et al.
TEMS—a division of ND Industries, Inc.; "Low Pressure Injection Overmolding Ruggedizing Electrical/Electronic Components"; www.temsnd.com.
Peltsman; "Low Pressure Injection Molding"; www.pelcor.com.
Peltsman; "Automatic LPM Machine MIGL-37"; www.pelcor.com.
Axom.com; "Low Pressure Powder Injection Moulding of Metals, Ceramics and Metal Matrix Composites"; www.azom.com.
Goceram; "Medium Pressure Powder Injection Molding (MEDPIMOLD) Process"; www.goceram.com.
Goceram; "Medium Pressure Injection Moulding Machines"; www.goceram.com.
Powder Metallurgy 2007 Facts—"A Growth Industry Vital to Many Products"; Metal Powder Industries Federation.
Power Injection Moulding International (PIM International) "Flexibility Helps MIM Producer Meet the Demands of a Broad Client Base".
"An Introduction to Powder Metallurgy Materials and Design", Isabel J van Rooyen, Metals and Metals Processes, CSIR, Private bag X28, Auckland Park, 2006, South Africa.
NMC: "Enhanced Powder Metallurgy Processing of Superalloys for Aircraft Engine Components".
Nato:"Powder Injection Molding (PIM) for Low Cost Manufacturing of Intricate Parts to Net-Shape", Eric Baril et al., pp. 7-1 to 7-12.
Nato: "Metal Injection Moulding: A Near Net Shape Fabrication Method for the Manufacture of Turbine Eny;ne Component", Benoit Julien et al., pp. 8-1 to 8-16.
Polymer Technologies, Inc.; "Plastic and Metal Injection Molding"; www.polymertechnologies.com.
Phillips Plastics Corporation; "MIM Metal Injection Molding Design Guide"; Nov. 12, 2004; www.phillipsmetals.com.
Egide; "Advanced Material Injection Moulding (AMIM)".
"The MIM Process"; www.epma.com.
"Powder Injection Molding"; www.powdermetinc.com/Technology.htm.
COBEF (Congresso Braileiro de Engenharia de Fabricacao); Paulo César G. Felix; Philip Frank Blazdel; Ricardo Emilio F.Q Nogueira; "*Production of Complex Parts by Low-Pressure Injection Molding of Granite Powders*".
J.E. Zorzi; C.A. Perottoni; J.A. H. da Jornada; "Wax-Based Binder for Low-Pressure Injection Molding and the Robust Proudction of Ceramic Parts".
Azom.com; "Powder Injection Moulding of Metals, Ceramics and Metal Matrix Composites"; www.azom.com.
Ceramic Industry; Ceratechno '06;.Nov. 7-11, 2006; "Advancing Components with Low-Pressure Injection Molding"; www.ceramicindustry.com.
"Injection Molding Microstructures"; www.ecs.umass.edu.

* cited by examiner

COMBUSTOR HEAT SHIELD WITH INTEGRATED LOUVER AND METHOD OF MANUFACTURING THE SAME

TECHNICAL FIELD

The present invention relates to gas turbine engine combustors and, more particularly, to combustor heat shields with film cooling louvers.

BACKGROUND OF THE ART

Heat shields are used to protect combustor shells from high temperatures in the combustion chamber. They are typically cast from high temperature resistant materials due to their proximity to the combustion flame. Casting operations are not well suited for complex-shaped parts and as such several constrains must be respected in the design of a combustor dome heat shield. For instance, a heat shield could not be cast with a film cooling louver due to the required tight tolerances between the louver and the heat shield. Also several secondary shaping operations must be performed on the cast heat shield to obtain the final product. Drilling and other secondary shaping operations into high temperature cast materials lead to high tooling cost as wear rates of drills and other shaping tools requires frequent cutting tool re-shaping or replacement.

There is thus a need for further improvements in the manufacture of combustor heat shields.

SUMMARY

In one aspect, there is provided a method for manufacturing a combustor heat shield, comprising the steps of: a) metal injection molding a green heat shield body; b) metal injection molding, a green cooling louver; c) positioning said green cooling louver in partial abutting relationship with said green heat shield body so as to form an air cooling gap between a front face of the green heat shield body and the green cooling louver; and d) while said (green heat shield body is in intimate contact with said green cooling louver, co-sintering said green heat shield body and said green cooling louver at a temperature sufficient to fuse them together into a one-piece component.

In a second aspect, there is provided a combustor dome heat shield and louver assembly, comprising a metal injection molded heat shield body, a metal injection molded louver, said metal injection molded heat shield and said metal injection molded louver having a pair of interfacing surfaces, and a seamless bond between said metal injection molded heat shield and said metal injection molded louver at said interfacing surfaces.

DESCRIPTION OF THE PREFERRED EMBODIMENTS

Figure 1:
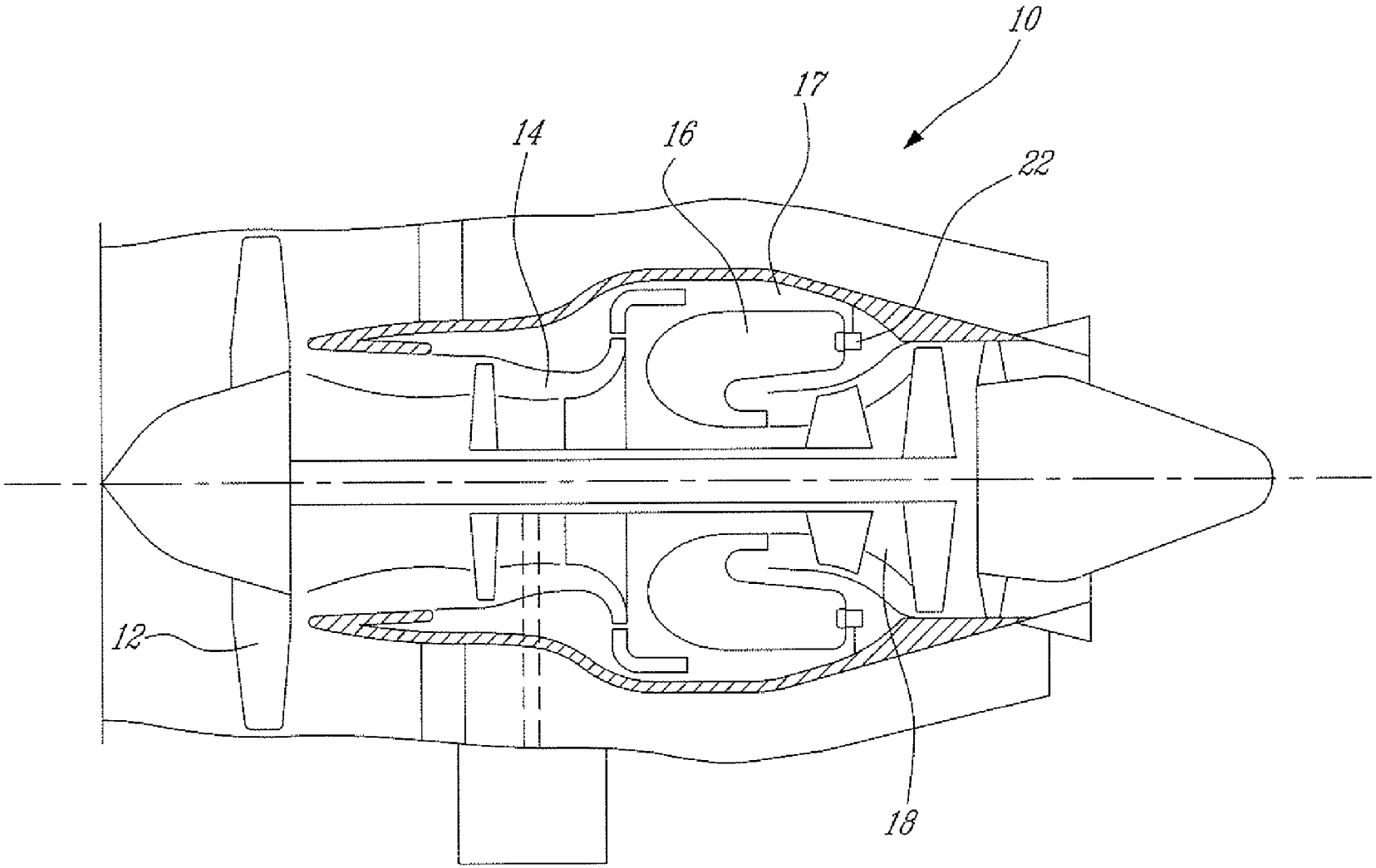
FIG. 1 is a schematic cross-sectional view of a gas turbine engine having an annular combustor.

FIG. 1 illustrates a gas turbine engine 10 generally comprising in serial flow communication a fan 12 (not provided with all types of engine) through which ambient air is propelled, a multistage compressor 14 for pressurizing the air, a combustor 16 in which the compressed air is mixed with fuel and ignited for generating an annular stream of hot combustion gases, and a turbine 18 for extracting energy from the combustion gases.

Figure 2:
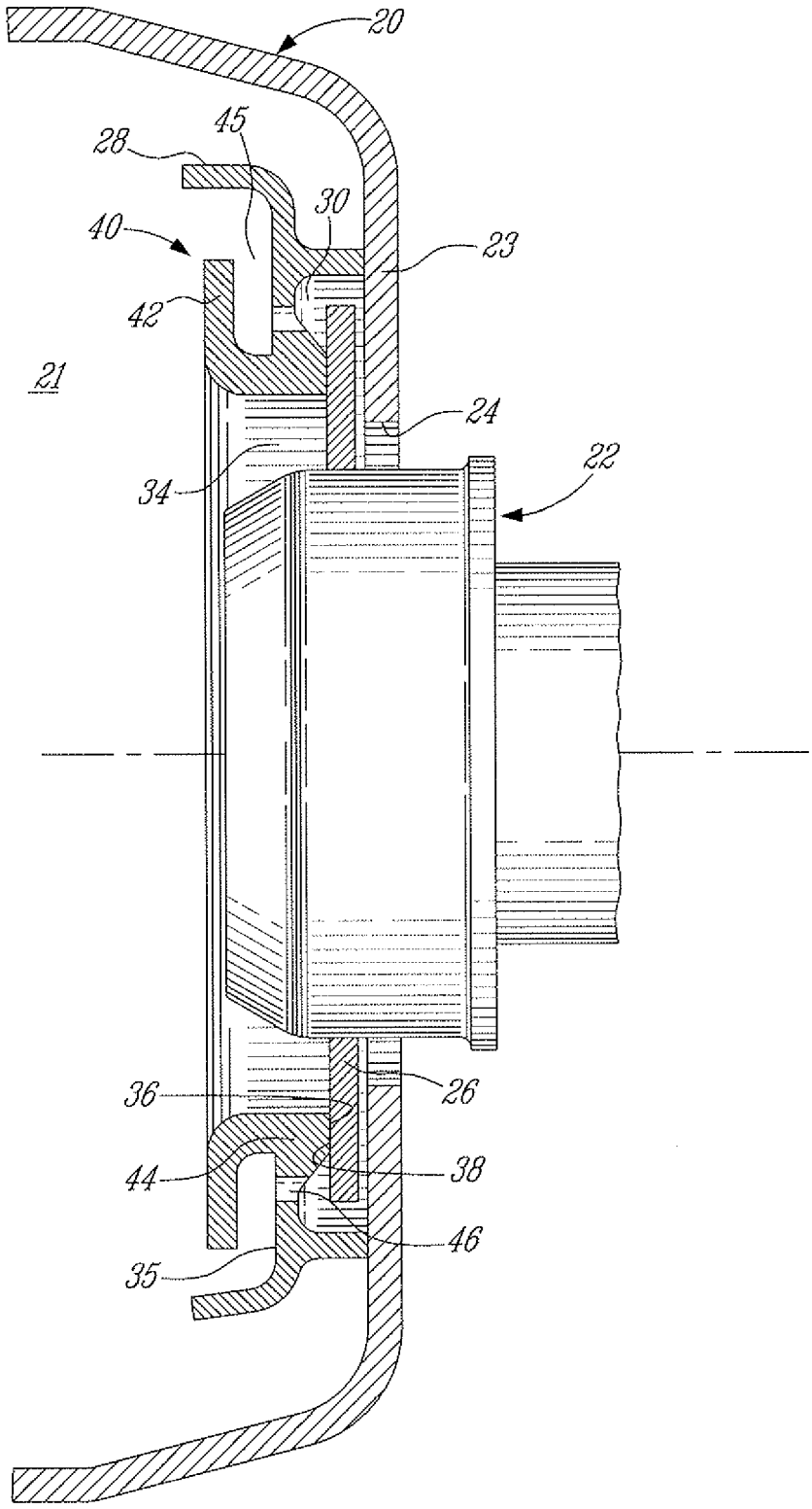
FIG. 2 is an enlarged cross-sectional view of a dome portion of the combustor, the combustor shell being protected against excessive heat by a heat shield having a louver for directing a film of cooling air on a hot surface of the heat shield.

The combustor 16 is housed in a plenum 17 supplied with compressed air from compressor 14. As shown in FIG. 2, the combustor 16 typically comprises a combustion shell 20 defining a combustion chamber 21 and a plurality of fuel nozzles (only one being shown at 22), which are typically equally spaced about the circumference of the combustion chamber 21 in order to permit a substantially uniform temperature distribution in the combustion chamber 21 to be maintained. The combustion shell 20 is typically made out from sheet metal. In use, fuel provided by a fuel manifold (not shown) is atomized by the fuel nozzles into the combustion chamber 21 for ignition therein, and the expanding gases caused by the fuel ignition drive the turbine 18 in a manner well known in the art.

Figure 3:
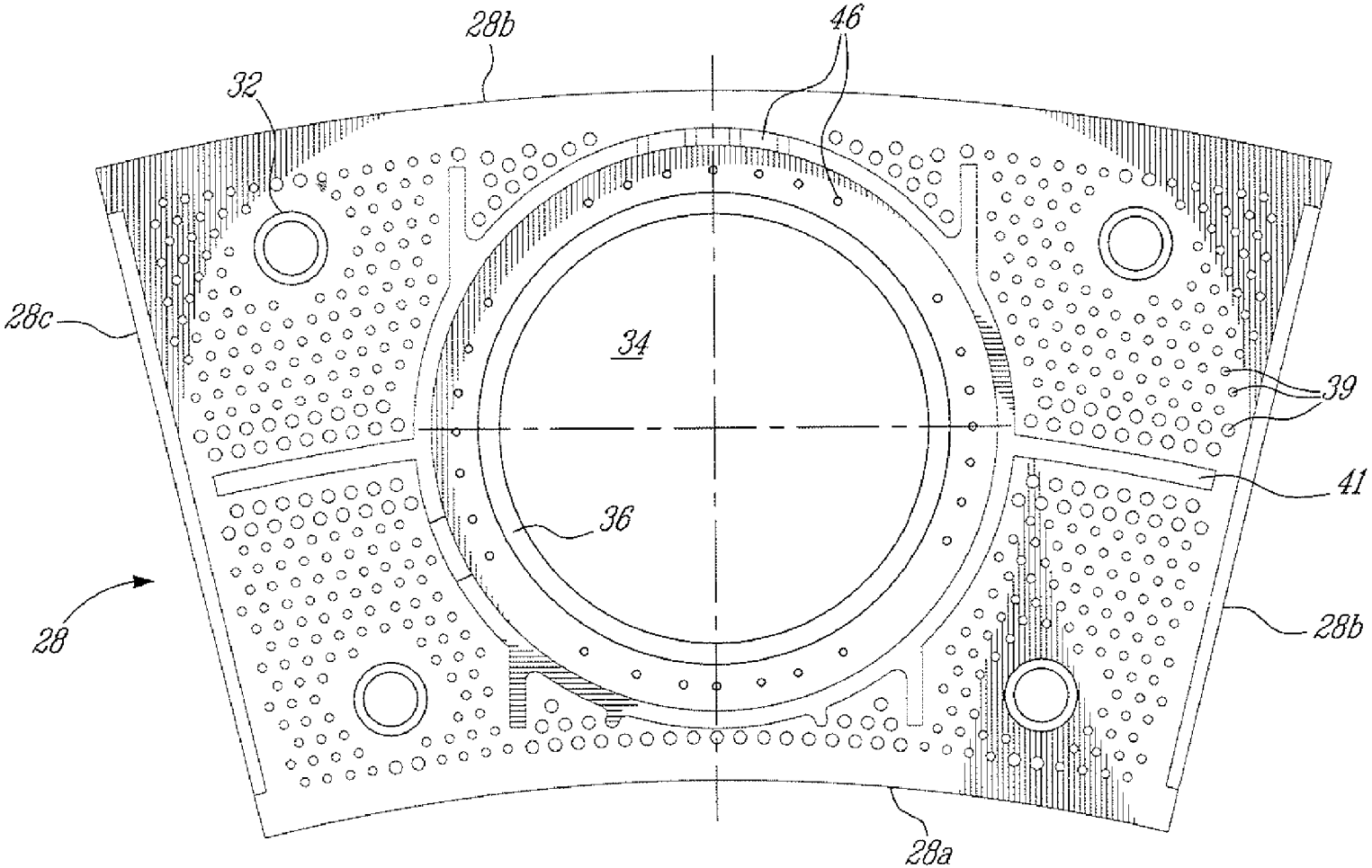
FIG. 3 is a back plan view of a heat shield segment.

As shown in FIG. 2, each fuel nozzle 22 is received in an opening 24 defined in a dome panel 23 of the combustor shell 20. A floating collar 26 is provided between the combustor shell 20 and the fuel nozzle 22. The floating collar 26 provides sealing between the combustor shell 20 and the fuel nozzle 22 while allowing relative movement therebetween. In the axial direction, the floating collar 26 is trapped between the dome panel 23 and a dome heat shield body 28. As shown in FIG. 3, the heat shield body 28 is provided in the form of an arcuate segment extending between a radially inner edge 28*a* and a radially outer edge 28*b* and two opposed lateral edges 28*c* and 28*d*. A plurality of heat shield bodies 28 are circumferentially disposed in an edge-to-edge relationship to form a continuous 360 degrees annular band on the dome panel 23 of the combustor shell 20. Each heat shield 28 is mounted to the dome panel 23 of the combustor shell 20 at a distance therefrom to define an air gap 30 (FIG. 2). In the illustrated example, the heat shield body 28 is attached to the combustor shell 20 by means of a number of threaded studs 32 (four the example illustrated in FIG. 3) extending at right angles from the back side of the heat shield body 28. The studs 32 protrude through corresponding holes in the dome panel 23 and are secured thereto by washers and self-locking nuts (not shown). Other fastening means could be used as well. A central circular opening 34 is defined in the heat shield body 28 for receiving the fuel nozzle 22. The heat shield body 28 is provided on the back side thereof with an annular flat sealing shoulder 36 which extends about the opening 34 for cooperating with a corresponding flat surface 38 on the front face of the floating collar 26. In operation, compressed air supplied from the engine compressor 14 into the plenum 17 in which the combustor 16 is mounted urges the flat surface 38 of the floating collar 26 against the flat surface 36 of the heat shield body 28, thereby providing a seal at the interface between the heat shield body 28 and the floating collar 26. Holes (not shown) are defined through the combustor shell 20 for directing cooling air into the air gap 30 to cool the back face of the heat shield 28. As shown in FIG. 3, heat exchange promoting structures such as pin fins 39, trip strips and divider walls 41 can be integrally formed on the back side of the heat shield 28 to increase cooling effectiveness.

As shown in FIG. 2, a film cooling louver 40 is provided on the front side of the heat shield body 28. The louver 40 has a radially extending annular deflector portion 42 bending smoothly into an axially rearwardly extending annular flange portion 44. The annular deflector portion 42 extends generally in parallel to and downstream of the front hot surface 35 of the heat shield body 28. The deflector portion 42 is axially spaced from the hot surface 35 of the heat shield 28 so as to define an air gap or plenum 45 therebetween. According to one embodiment, a gap of 0.040" is provided between the deflector portion 42 and the heat shield 28. The gap is calculated for optimum cooling of the heat shield front face 35. A series of circumferentially distributed cooling holes 46 are defined through the heat shield body 28 about the central opening 34 for allowing cooling air to flow from the air gap 30 into plenum 45 between the louver 40 and the heat shield body 28. The louver 40 re-directs the cooling air flowing through the cooling holes 46 along the hot surface 35. The air deflected by the louver 40 forms a cooling air film on the hot front surface 35 of the heat shield 28. This provides a simple and economical way to increase the heat shield cooling effectiveness.

Figure 4A:
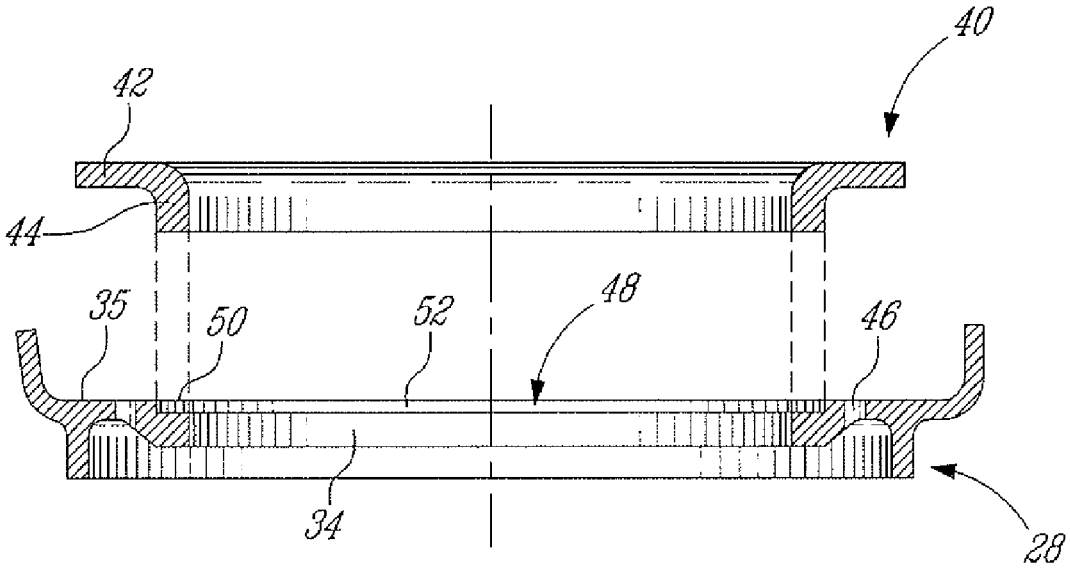
FIGS. 4*a* and 4*b* are cross-sectional views illustrating the process by which a metal injection molded louver is permanently fused to a metal injection molded heat shield body by means of a co-sintering process.
Figure 4B:
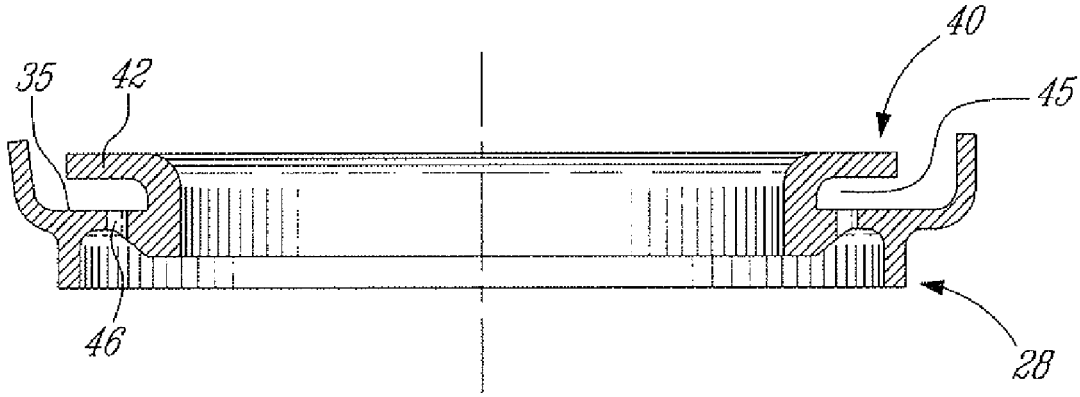

As can be appreciated from FIGS. 4*a* and 4*b*, the heat shield body 28 and the louver 40 are manufactured as separate parts by metal injection molding (MIM) and then the "green" heat shield body and the "green" louver are fused together by means of a co-sintering process. The heat shield body 28 and the louver 40 are made from a high temperature resistant powder injection molding composition. Such a composition can include powder metal alloys, such as IN625 Nickel alloy, or ceramic powders or mixtures thereof mixed with an appropriate binding agent. Other high temperature resistant compositions could be used as well. Other additives may be present in the composition to enhance the mechanical properties of the heat shield and louver (e.g. coupling and strength enhancing agents).

An interfacing annular recess 48 is molded in the front face 35 of the heat shield body 28 coaxially about the central opening 34 for matingly receiving the axially extending flange portion 44 of the louver 40 in intimate contact. The annular recess 48 is bonded by an axially extending shoulder 50 and a radially oriented annular shoulder 52 for interfacing in two normal planes with corresponding surfaces of the axially extending flange portion 44 of the louver 40. This provides for a strong bonding joint between the two parts. The engagement of the axially extending flange portion 44 in the recess 48 of the heat shield 28 also ensures proper relative positioning of the two metal injection molded parts. Accordingly, the louver 40 and the heat shield 28 can be accurately positioned with respect to each other without the need for other alignment structures or fixtures. However, it is understood that the louver 40 and the heat shield 28 could be provided with other suitable male and female aligning structures. The axial cooling gap 45 between the louver 40 and the heat shield 28 is determined by the length of the axially extending flange portion 44 of the louver 40 and the depth of the recess 48 of the heat shield body 28. The cooling holes 46 are molded in place through the heat shield 28. This eliminates the extra step of drilling holes through the heat shield body.

As shown in FIG. 4*a*, the MIM green louver 40 is placed on top of the MIM green heat shield body 28 while the same is being horizontally supported with its front surface 35 facing upwardly. This operation could also be accomplished in other orientations. The MIM green heat shield body 28 can be held by a fixture to prevent movement thereof while the MIM green louver 40 is being lowered into the interfacing recess 48 of the MIM green heat shield body 28. The MIM green louver 40 can be gently pressed downwardly by hand onto the MINI green heat shield body 28 to ensure intimate and uniform contact between flange portion 44 and shoulders 50 and 52. The applied force must be relatively small so as to not deform the green parts.

Once the MIM green louver 40 is appropriately positioned on the MINI green heat shield body 28, the resulting assembled green part is submitted to a debinding operation to remove the binder or the binding agent before the parts by permanently fused together by heat treatment. The assembled green part can be debound using various aqueous debinding solutions and heat treatments known in the art. It is noted that the assembly of the two separately molded parts could be done either before or after debinding. However, assembly before debinding is preferable to avoid any surface deformation at the mating faces of both parts during the debinding process. It also helps to bind the two parts together.

After the debinding operations, the louver 40 and the heat shield body 28 are co-sintered together to become a seamless unitary component as shown in FIG. 4*b*. The heat shield body 28 and the louver are preferably fused along their entire interface provided between shoulders 50 and 52 and the axially extending flange portion 44. The sintering operation can be done in inert gas environment or vacuum environment depending on the injection molding composition. Sintering temperatures are typically in the range of about 1100 to about 1200 Degrees Celsius depending on the base material composition of the powder. The co-sintering operation of the heat shield body 28 and the louver 40 takes about 4-8 hours followed by annealing (slow cooling). In some cases, it may be followed with hot isostatic pressing (HIP)—annealing under vacuum to minimize porosities. It is understood that the parameters of the co-sintering operation can vary depending on the composition of the MIM feedstock and on the configuration of the louver 40 and of the heat shield body 28.

It is noted that the density and size (i.e diameter and height) of the pin fins and the other heat exchange promoting structures on the back side of the heat shield halve been selected to suit a MIM process and permit easy unmolding of the part. Some of the pin fins near the divider walls have also been integrated to the wall to avoid breakage during, moulding.

The above description is meant to be exemplary only, and one skilled in the art will recognize that changes may be made to the embodiments described without department from the scope of the invention disclosed. For example, the invention may be provided in any suitable heat shield and louver configuration and in and is not limited to application in reverse flow annular combustors. Still other modifications which fall within the scope of the present invention will be apparent to those skilled in the art, in light of a review of this disclosure, and such modifications are intended to fall within the appended claims.

What is claimed is:

1. A method for manufacturing a combustor heat shield for use in a combustor of a gas turbine engine, comprising the steps of: a) metal injection molding a green heat shield body; b) metal injection molding a green cooling louver; c) positioning said green cooling louver in partial abutting relationship with said green heat shield body so as to form an air cooling gap between a front face of the green heat shield body and the green cooling louver, including inserting a male portion on one of said green cooling louver and said green heat shield in an axially abutting position within a corresponding female portion on another one of said green cooling louver and said green heat shield body, a length of the male portion relative to a depth of the female portion defining said air cooling gap; and d) while said green heat shield body is in intimate contact with said green cooling louver, co-sintering said green heat shield body and said green cooling louver at a temperature sufficient to fuse them together into a one-piece component.

2. The method of claim 1, wherein step a) comprises molding the green heat shield body with a series of holes extending thickness-wise there through, said holes being disposed such as to be in fluid flow communication with said air cooling gap once said green cooling louver is mounted to said green heat shield body.

3. The method of claim 1, wherein step a) comprises molding the green heat shield body with a shoulder formed in the front face thereof, and wherein step b) comprises molding the green cooling louver with a corresponding abutment flange, and wherein said abutment flange is configured for mating engagement with said shoulder.

4. The method of claim 3, wherein said shoulder circumscribed a central opening formed through the green heat shield during step a).

5. The method of claim 4, wherein said shoulder and said abutment flange are annular and configured to tightly fit within one another.

6. The method of claim 1, comprising conducting a joint debinding operation on said green cooling louver and said green heat shield body after step c).

* * * * *